US010449430B2

(12) United States Patent
Plante et al.

(10) Patent No.: US 10,449,430 B2
(45) Date of Patent: Oct. 22, 2019

(54) HOCKEY STICK WITH SPINE-REINFORCED PADDLE

(71) Applicant: Bauer Hockey Ltd., Blainville (CA)

(72) Inventors: Dominique Plante, Pointe-Claire (CA); Martin Chambert, Piedmont (CA)

(73) Assignee: Bauer Hockey Ltd., Blainville (CA)

( * ) Notice: Subject to any disclaimer, the term of this patent is extended or adjusted under 35 U.S.C. 154(b) by 0 days.

(21) Appl. No.: 16/270,817

(22) Filed: Feb. 8, 2019

(65) Prior Publication Data

US 2019/0168089 A1 Jun. 6, 2019

Related U.S. Application Data

(62) Division of application No. 15/597,958, filed on May 17, 2017, now Pat. No. 10,232,238.

(51) Int. Cl.
*A63B 59/70* (2015.01)
*A63B 102/24* (2015.01)

(52) U.S. Cl.
CPC ..... *A63B 59/70* (2015.10); *A63B 2102/24* (2015.10)

(58) Field of Classification Search
CPC .. A63B 59/70; A63B 2102/24; A63B 2209/02
USPC ..... 473/560–563
See application file for complete search history.

(56) References Cited

U.S. PATENT DOCUMENTS

| | | | |
|---|---|---|---|
| 1,183,473 | A | 5/1916 | McNiece |
| D241,758 | S | 10/1976 | Matilainen |
| D244,790 | S | 6/1977 | Carlson et al. |
| D263,329 | S | 3/1982 | Clayton |
| 4,340,224 | A | 7/1982 | Staats |
| 4,544,157 | A | 10/1985 | Curtis |
| 4,651,990 | A | 3/1987 | Profit |
| D344,115 | S | 2/1994 | Goyette |
| 5,429,352 | A | 7/1995 | Leclerc |
| D363,326 | S | 10/1995 | LeClerc |
| 5,456,463 | A | 10/1995 | Dolan et al. |
| 5,484,146 | A | 1/1996 | Loschiavo |
| 5,511,776 | A | 4/1996 | Huru |
| 5,603,498 | A | 2/1997 | Crawford et al. |
| 5,672,129 | A | 9/1997 | Fisher et al. |
| 5,816,949 | A | 10/1998 | Dutchburn |
| 5,827,141 | A | 10/1998 | Lukey et al. |
| 5,863,268 | A | 1/1999 | Birch |
| D406,625 | S | 3/1999 | Hutzenlaub |
| D418,182 | S | 12/1999 | Krist |
| 5,997,970 | A | 12/1999 | You |
| 6,062,996 | A | 5/2000 | Quigley et al. |
| 6,099,421 | A | 8/2000 | Mayhew |
| D431,621 | S | 10/2000 | Pagotto et al. |
| 6,234,923 | B1 | 5/2001 | Gentile |
| D444,520 | S | 7/2001 | O'Malley |
| D458,329 | S | 6/2002 | Clark, Jr. et al. |
| 6,471,609 | B1 | 10/2002 | Fell |

(Continued)

FOREIGN PATENT DOCUMENTS

| | | | |
|---|---|---|---|
| CA | 2244610 | A1 | 2/1999 |
| CA | 2237738 | A1 | 12/1999 |

(Continued)

*Primary Examiner* — Mark S Graham
(74) *Attorney, Agent, or Firm* — Banner & Witcoff, Ltd.

(57) ABSTRACT

A construct for a hockey stick blade and paddle structure having a spine that protrudes from a back face and provides structural rigidity, as well as recessed areas that reduce the mass of the paddle structure.

20 Claims, 15 Drawing Sheets

(56) References Cited

U.S. PATENT DOCUMENTS

| | | | |
|---|---|---|---|
| D496,703 | S | 9/2004 | Gans |
| 7,044,870 | B2 | 5/2006 | Pagotto |
| 7,294,072 | B2 | 11/2007 | Montecchia |
| D558,844 | S | 1/2008 | Jeanneau et al. |
| 7,326,136 | B2 | 2/2008 | Jean et al. |
| 7,438,655 | B2 | 10/2008 | Garcia |
| D579,997 | S | 11/2008 | Jeanneau et al. |
| 7,476,167 | B2 | 1/2009 | Garcia |
| D594,920 | S | 6/2009 | Drouin et al. |
| D595,368 | S | 6/2009 | Drouin et al. |
| D595,792 | S | 7/2009 | Drouin et al. |
| 7,914,403 | B2 | 3/2011 | Ie |
| D684,225 | S | 6/2013 | LaCroix |
| 8,608,597 | B2 | 12/2013 | Avnery et al. |
| 8,801,550 | B2 | 8/2014 | Jeanneau et al. |
| 8,905,873 | B2 | 12/2014 | Lowden |
| 9,039,549 | B2 | 5/2015 | Villar et al. |
| 9,044,658 | B2 | 6/2015 | Xun et al. |
| 9,101,804 | B2 | 8/2015 | Brenner |
| 9,248,356 | B2 | 2/2016 | Pearson et al. |
| D752,166 | S | 3/2016 | Kozac |
| 9,320,952 | B2 | 4/2016 | Downing et al. |
| 9,421,441 | B2 | 8/2016 | Cross |
| D770,581 | S | 11/2016 | Gosselin |
| D770,582 | S | 11/2016 | Gosselin |
| 9,586,112 | B2 | 3/2017 | Sola et al. |
| 9,687,706 | B1 | 6/2017 | Cormier |
| 2005/0070382 | A1 | 3/2005 | Loschiavo |
| 2005/0130759 | A1 | 6/2005 | Hayden et al. |
| 2005/0215365 | A1 | 9/2005 | Lussier et al. |
| 2006/0046866 | A1 | 3/2006 | Rigoli |
| 2006/0217218 | A1 | 9/2006 | Ponzini |
| 2006/0281591 | A1 | 12/2006 | Wikstrom et al. |
| 2007/0275795 | A1 | 11/2007 | Barkume |
| 2008/0026885 | A1 | 1/2008 | Lamson et al. |
| 2009/0005198 | A1 | 1/2009 | Shiu |
| 2009/0264229 | A1 | 10/2009 | Forsberg |
| 2010/0087281 | A1 | 4/2010 | Kotula |
| 2010/0125010 | A1 | 5/2010 | Martin |
| 2010/0323829 | A1 | 12/2010 | Cross et al. |
| 2012/0046136 | A1 | 2/2012 | Allen et al. |
| 2012/0202625 | A1 | 8/2012 | McGibbon |
| 2012/0244968 | A1 | 9/2012 | Jeanneau |
| 2012/0283054 | A1 | 11/2012 | Jeanneau et al. |
| 2013/0045822 | A1 | 2/2013 | Stefan |
| 2015/0126310 | A1 | 5/2015 | Brenner |
| 2016/0236050 | A1 | 8/2016 | Allard et al. |
| 2017/0319924 | A1 | 11/2017 | Nalbandian |
| 2017/0326423 | A1 | 11/2017 | Kozac |

FOREIGN PATENT DOCUMENTS

| | | | |
|---|---|---|---|
| DE | 8808330 | U1 | 9/1988 |
| GB | 336027 | A | 10/1930 |
| GB | 2032123 | | 5/1994 |
| GB | 2032124 | | 5/1994 |
| GB | 2462191 | A | 2/2010 |
| WO | D013665-001 | | 7/1989 |
| WO | D024879-001 | | 3/1993 |
| WO | D024879-002 | | 3/1993 |

HOCKEY STICK WITH SPINE-REINFORCED PADDLE

CROSS-REFERENCE TO RELATED APPLICATIONS

This application is a divisional of U.S. patent application Ser. No. 15/597,958, filed May 17, 2017, which is incorporated herein by reference in its entirety for any and all non-limiting purposes.

FIELD

This disclosure relates generally to fabrication of molded structures. More particularly, aspects of this disclosure relate to hockey blade and paddle structures.

BACKGROUND

The fast pace at which the game of hockey is played requires players to react quickly in order to score goals, and conversely, as in the case of the goalie as well as the defensive players, to prevent goals from being scored against. Reducing the mass of equipment, and in particular, the hockey stick, can, in certain examples, be desirable in order to reduce inertia and decrease the time it takes for a player to move his/her stick to a desired position. Aspects of this disclosure relate to improved methods for production of a reinforced hockey stick blade and paddle having reduced mass and equal or improved structural characteristics.

SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Aspects of the disclosure herein may relate to fabrication of a formed hockey blade and paddle structure. In one example, the formed hockey blade and paddle structure may include a reinforcing spine that provides structural rigidity to the paddle, and one or more recessed areas that reduce the overall mass of the paddle. The fabrication of the formed hockey blade and paddle structure may include molding one or more layers of fiber tape by heating and cooling within a mold to produce a formed hockey blade and paddle structure.

BRIEF DESCRIPTION OF THE DRAWINGS

The present disclosure is illustrated by way of example and not limited in the accompanying figures in which like reference numerals indicate similar elements and in which.

Further, it is to be understood that the drawings may represent the scale of different component of one single embodiment; however, the disclosed embodiments are not limited to that particular scale.

DETAILED DESCRIPTION

In the following description of various example structures, reference is made to the accompanying drawings, which form a part hereof, and in which are shown by way of illustration various embodiments in which aspects of the disclosure may be practiced. Additionally, it is to be understood that other specific arrangements of parts and structures may be utilized, and structural and functional modifications may be made without departing from the scope of the present disclosures. Also, while the terms "top" and "bottom" and the like may be used in this specification to describe various example features and elements, these terms are used herein as a matter of convenience, e.g., based on the example orientations shown in the figures and/or the orientations in typical use. Nothing in this specification should be construed as requiring a specific three-dimensional or spatial orientation of structures in order to fall within the scope of this invention.

Aspects of this disclosure relate to systems and methods for production of a paddle of a hockey stick with a spine that provides structural rigidity, as well as recessed areas that reduce the mass of the paddle structure.

Figure 1A:
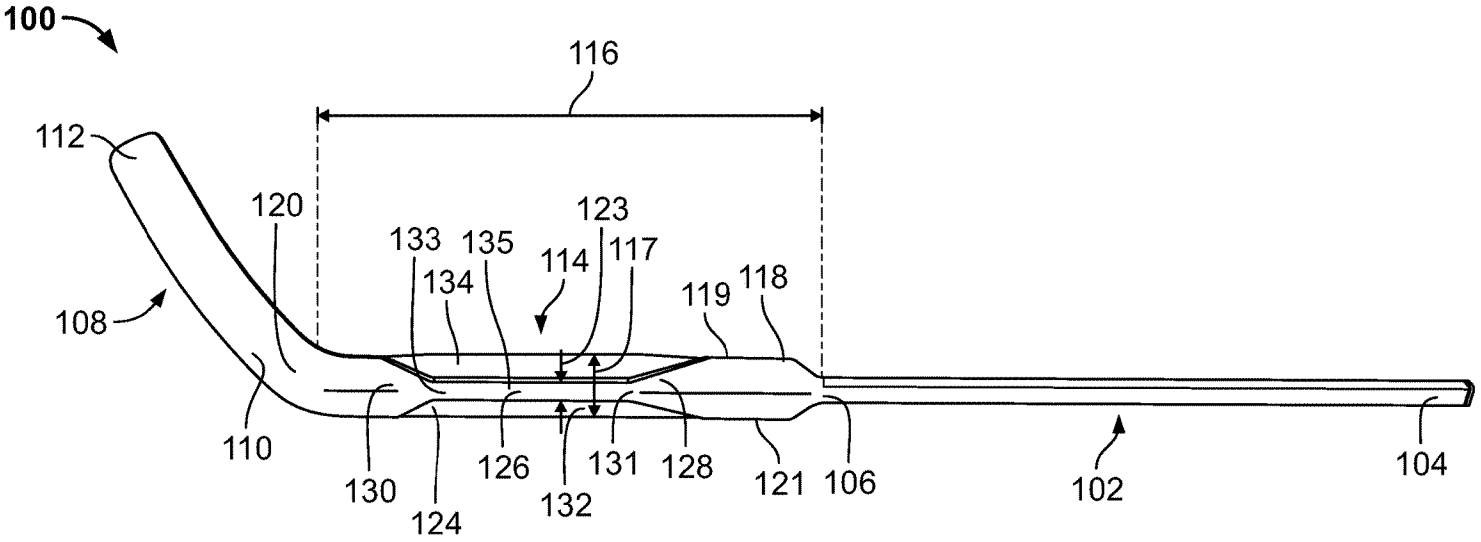
FIGS. 1A and 1B depict a respective back side and front side of a hockey stick, according to one or more aspects described herein.
Figure 1B:
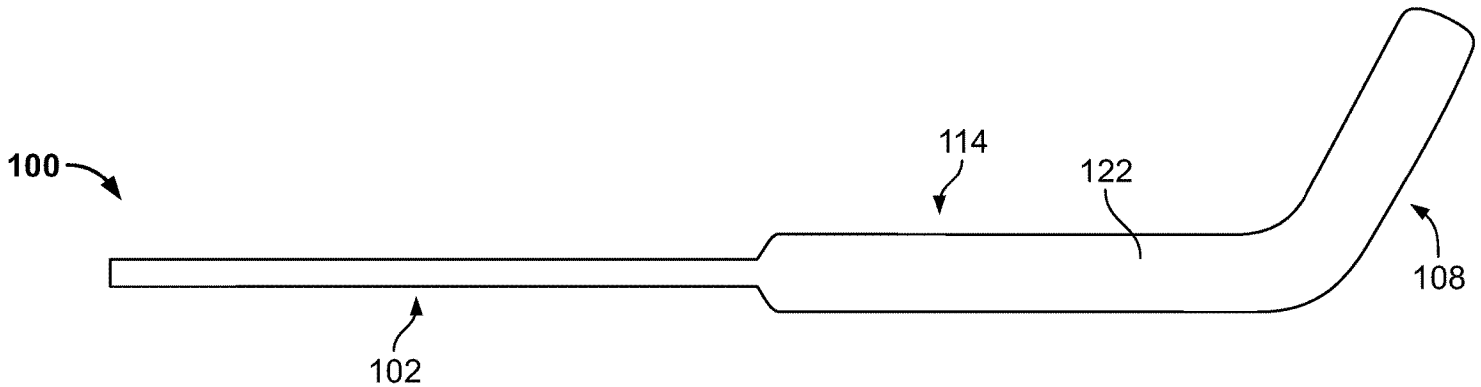

FIGS. 1A and 1B depict a respective back side and front side of a hockey stick 100, according to one or more aspects described herein. In particular, hockey stick 100 may be utilized as a goalie stick. However, the various disclosures described in relation to hockey stick 100 may be utilized in other stick implementations (e.g. non-goalie stick types), without departing from the scope of these disclosures. As depicted, hockey stick 100 has a curve and is intended to be gripped with a player's right hand. However, it is to be understood that the same disclosures described in relation to hockey stick 100 may be utilized in a stick with an opposite curve and may be configured to be gripped with a user's left-hand, without departing from the scope of these disclosures.

Hockey stick 100, which may otherwise be referred to as a hockey stick apparatus 100, may include a shaft 102 that has a proximal end 104 and a distal end 106. Additionally, the hockey stick 100 includes a blade 108 that has a proximal end 110, otherwise referred to as a blade heel 110 and a distal end 112, otherwise referred to as a blade toe 112. The hockey stick 100 may also include a paddle 114 that has a length 116 that extends between a proximal end 118 and a distal end 120. The paddle 114 may also have a width 117 that extends between a top edge 119 and a bottom edge 121. Accordingly, the distal end 120 of the paddle 114 may be coupled to the proximal end 110 of the blade 108, and the proximal end 118 of the paddle 114 may be coupled to the distal end 106 of the shaft 102. Additionally, the paddle 114 may include a front face 122, and a back face 124. A spine 126 may extend along a portion of the back face 124, with the spine 126 coupled to, and protruding out from the back face 124, the spine 126 may have a second width 123 that is less than the first width 117 of the paddle 114. The spine 126 may include a proximal end 131 and a distal end 133. A first transition element 128 may be coupled to the proximal end 131 of the spine 126 and the proximal end 118 of the paddle 114, and a second transition element 130 may be coupled to the distal end 133 of the spine 126 and the distal end 120 of the paddle 114. The paddle 114 may additionally include recessed areas 132 and 134. The paddle 114 may have a first thickness at the recessed areas 132 and 134 that extends between the front face 122 and the back face 124. Further, the paddle 114 may have a second thickness, greater than the first thickness, measured between the front face 122 and a back surface 135 of the spine 126.

In one implementation, it is contemplated that the paddle 114 and the blade 108 are integrally molded as a structure. In another implementation, the shaft 102, paddle 114, and blade 108 may all be integrally molded as a single hockey stick structure 100. Additionally, it is contemplated that a complete hockey stick structure 100 may be integrally molded from one or more subcomponents that were formed and/or molded separately before a final one or more molding processes to produce a integrally molded hockey stick 100. In particular, the paddle 114 and blade 108 may be molded together during a first set of molding processes, and the hockey shaft 102 may be rigidly coupled to the blade 108 and paddle 114 structure using one or more subsequent processes. Additionally or alternatively, one or more of the shaft 102, the paddle 114, and/or the blade 108 may be configured to be removably coupled to the hockey stick structure 100. It is additionally contemplated that the hockey stick structure 100 may include additional or alternative elements, such as a tacky outer surface on the shaft 102 to provide enhanced grip for a player, and/or an end cap on the shaft 104, without departing from the scope of these disclosures.

Advantageously, the elements of the paddle 114 provide enhanced structural and weighting characteristics to the hockey stick 100. In one example, the spine 126 may be configured to provide structural rigidity that includes resistance to bending and/or torsion of the paddle 114. Given the structural rigidity provided by spine 126, the back face 124 may include one or more recessed areas 132 and 134 that would otherwise include additional structural elements on conventional hockey stick paddles. Accordingly, the depicted implementation of the hockey stick paddle 114 may include less structural material than conventional implementations to achieve equal or better structural rigidity, and thereby reduce the overall mass of the paddle 114 and stick 100. Further, the structure provided by the spine 126 may allow the front face 122 to be constructed from additional layers of material (e.g. carbon fiber tape), and thereby increase the impact resistance and mass of the front face 122, while reducing the overall mass of the paddle 114, when compared to conventional paddle implementations. In one implementation, the front face 122 may have a thickness in certain areas that is approximately double that of a conventional hockey stick paddle structure. As such, the front face 122 may have an impact resistance/strength that is approximately 25-100% higher than a conventional paddle. However, it is contemplated that additional or alternative implementations may be utilized, such that the front face 122 of the paddle 114 may have further increased impact strength, without departing from the scope of these disclosures.

In one implementation, the paddle 114 may have a longitudinal axis approximately parallel to the top edge 119 and bottom edge 121. Further, the spine 126 may include a shaft that extends along at least a portion of the back face 124 approximately parallel to this longitudinal axis. In one example, the shaft that makes up the spine 126 may have a rectangular cross-section. However, additional spine 126 geometries are contemplated, without departing from the scope of these disclosures. For example, the shaft may have a circular or semicircular cross-section, or a triangular cross-section. Indeed, the shaft that makes up the spine 126 may include any prismal geometry, without departing from the scope of these disclosures. In yet another example, the shaft of the spine 126 may have an I-beam geometry, or C-shaped geometry, without departing from the scope of these disclosures. It is further contemplated that the spine 126 may be partially or wholly hollow and have a cavity extending along at least a portion of the spine 126 in a direction approximately parallel to the longitudinal axis of the paddle 114.

In one example, the paddle 114 may have a stiffness that supports approximately 50-65 lbs./inch of deflection on a 20-inch span between supports, and approximately 35-55 lbs./inch of deflection on a 22-inch span. However, it is contemplated that the paddle 114 may have different stiffness values, which may be larger than 65 lbs./inch and 55 lbs./inch on 20-inch and 22-inch spans, respectively, without departing from the scope of these disclosures. In contrast, a conventional implementation of a paddle of a hockey stick that does not include the spine 126 may have stiffness values that are approximately 10% lower than the paddle 114. In still further examples, a conventional implementation of a paddle of a hockey stick may have stiffness values that are more than 10% lower than paddle 114. As such, the depicted implementation of a paddle 114 having spine 126 may increase the paddle stiffness by approximately 10% or greater when compared to a conventional hockey stick paddle implementation. However, it is contemplated that the hockey stick 100, or other stick implementations described throughout this disclosure, may use different geometries to achieve further increased stiffness than the approximately 10% increase, without departing from the scope of these disclosures.

In one example, the paddle 114 may have a strength that supports a static load of approximately 300 to 360 lbs. or more before breaking on a 20-inch span across the paddle 114. In contrast, a conventional implementation of a paddle of a hockey stick that does not include the spine 126 may have a strength that is approximately 15-20% less than paddle 114. However, it is contemplated that the hockey stick 100, or other stick implementations described throughout this disclosure, may use different geometries to achieve further increased strength, without departing from the scope of these disclosures.

In one implementation, the implementation of the paddle 114 with the spine structure 126 may have a mass that is approximately 5-8% lower than a conventional paddle structure that does not have a spine 126, and hence, cannot be implemented with the recessed areas 132 and 134 which allow for reduced mass while maintaining or enhancing structural strength and/or stiffness. It is contemplated that further increased weight savings may be possible by using different implementations of a spine-reinforced paddle, similar to paddle 114, as described throughout these disclosures.

Figure 2:
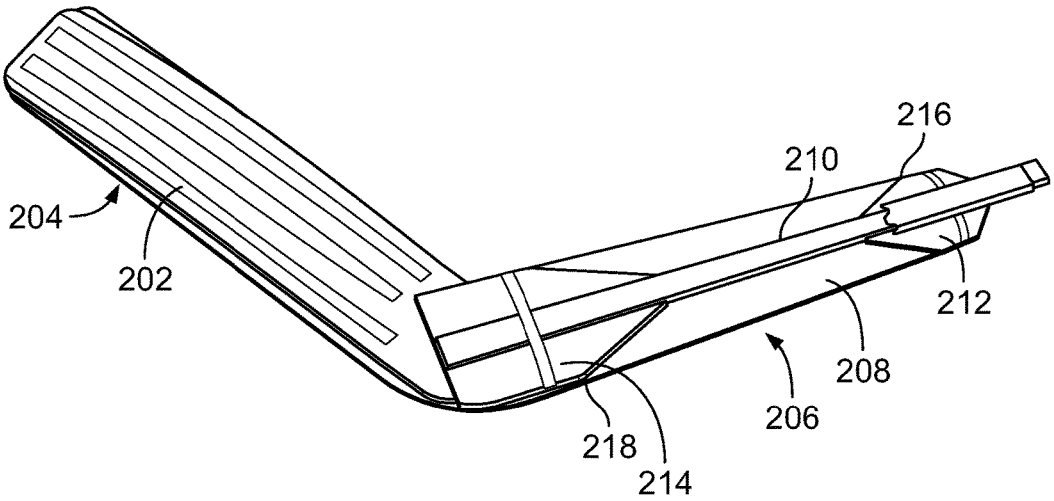
FIG. 2 depicts a stage of a process for fabricating a hockey stick paddle and blade structure, according to one or more aspects described herein.

FIG. 2 depicts a stage of a process for fabricating a hockey stick paddle and blade structure similar to that paddle 114 and blade 108 described in relation to FIGS. 1A and 1B. In certain examples, the method may include forming a first foam core 202 of a blade structure 204. This foam core 202 may be wrapped with a layer of fiber tape to form a wrapped blade core. In certain examples, foam core 202 of blade 204 may be a polymethacrylimide (PMI) foam. In one specific example, a Resin Infusion Manufacturing Aid (RIMA) low density PMI foam may be utilized in the foam core 100. This type of foam is a high strength foam that can withstand the shear and impact forces that result when a hockey blade strikes a hockey puck. Also in certain examples, multiple core structures can make up the core 202 of the blade. The multiple core structures may also be formed of varying density core structures. In certain examples, a higher density core can be placed toward the bottom of the hockey blade where many of the impacts occur, and a lower density core may be placed at the top of the blade. The core may also include epoxy and may also be formed with expandable microspheres. However, it is contemplated that additional or alternative foam materials may be utilized to construct the foam core 202, without departing from the scope of these disclosures. In an alternative example, the foam core 202 may be removed following one or more molding processes of the hockey stick blade 204. As such, the final blade structure may be formed of composite structures; carbon fiber walls that are reinforced by pins and molded with epoxy. In this alternative example, the foam may be removed by one or more mechanical processes (one or more machine tools may be utilized to remove the foam core 202, chemical processes (the foam may be degraded/dissolved by the addition of/exposure to a reactant/catalyst/solvent).

The paddle 206 may be formed by layering one or more layers of fiber tape. These one or more layers of fiber tape form the front face (not depicted in FIG. 2) and the back face 208, which are similar to the front face 122 and back face 124 of paddle 114. A spine 210, similar to spine 126, may be formed by wrapping a mandrel with one or more layers of fiber tape. In one example, the mandrel may be constructed from a silicone material, and may be removed from the spine 210 following one or more molding processes, producing a hollow spine structure similar to that described in relation to spine 126. First and second transition elements 212 and 214 may be formed by wrapping first and second transition element foam cores (not depicted in FIG. 2) with one or more layers of fiber tape. It is contemplated that the first and second transition element foam cores may include one or more of the same foam materials as the hockey blade foam core 202. As depicted, the spine 210 may be positioned on the back face 208, the first transition element 212 may be positioned at a proximal end 216 of the back face 208, and the second transition element 214 may be positioned at a distal end 218 of the back face 208.

Figure 3:
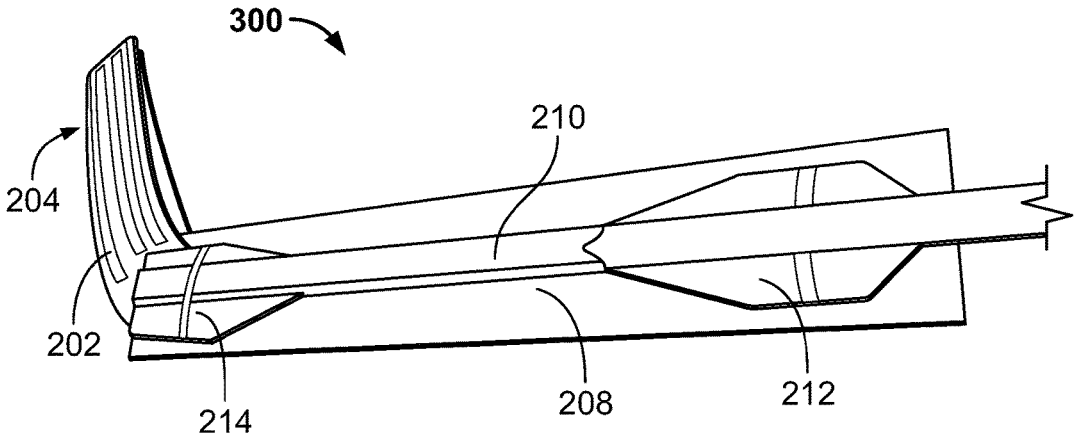
FIG. 3 depicts another stage of a process for fabricating a hockey stick paddle and blade structure, according to one or more aspects described herein.

One or more additional layers of fiber tape may be wrapped around the front face, the spine 210, and the transition elements 212 and 214, which have been positioned on the back face 208, to form a wrapped paddle structure 300, as depicted in FIG. 3. Prior to one or more molding processes, this wrapped paddle structure 300 may be loosely positioned proximate, or coupled to the wrapped blade core 204 by one or more structural elements (interlocking or otherwise), fasteners, adhesives and/or layers of fiber tape.

It is contemplated that the systems and methods described herein directed to a spine-reinforced paddle and blade structure of a hockey stick may utilize carbon fiber-reinforced structural elements that are molded together. The carbon-fiber may be applied as one or more tape layers that are pre-impregnated with epoxy, and which are heated and cooled to bond the structural elements together. However, it is contemplated that the systems and methods described herein may be applied to hockey stick implementations using additional or alternative materials, including thermoplastics reinforced with carbon or glass fibers (short or long fibers), thermoset resins reinforced with carbon, glass, aramid, basalt, plastic fibers (such as polypropylene or polyethylene, among others), and/or non-reinforced thermoplastics and thermosets (polyurethane, polyether ether ketone (PEEK) and/or nylon, among others).

It is further contemplated that the various structures described throughout this disclosure (e.g. blade 204, paddle face 208, spine 210, and/or transition elements 212 and 214, among others) may utilize certain reinforced structures that form bridges between the faces of the blade 204 or the paddle. In one example, the core forming the blade or the paddle can be formed of multiple core elements that are individually wrapped with one or more of pre-preg or dry fibers. In this example, when the blade or paddle is molded the fibers can create one or more bridges between the faces of the blade or the paddle. Further details pertaining to blade bridges are described in U.S. Pat. Nos. 7,097,577, 7,850,553, and 7,789,778, the entire contents of which are incorporated herein by reference for any and all non-limiting purposes. In other examples one or more fibers can be inserted into the core structure to create one or more bridges between the faces of the blade or the paddle. In another example, fiber pins (e.g. carbon fiber pins) may be injected into a foam core prior to molding of fiber-tape around the foam core. These fiber pins may provide enhanced strengthening to the various structural elements. Further details of this pin reinforcement methodology are described in U.S. patent application Ser. No. 15/280,603, filed 29 Sep. 2016, the entire contents of which are incorporated herein by reference for any and all non-limiting purposes.

Figure 4A:
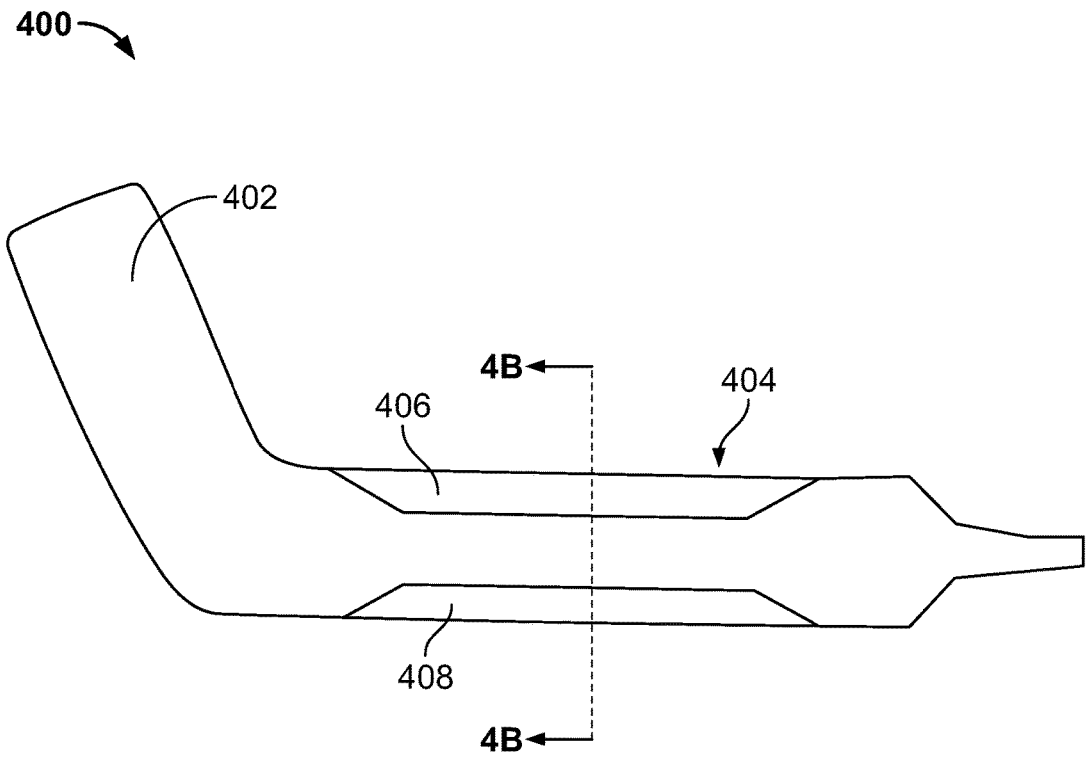
FIG. 4A schematically depicts an example of a wrapped blade and paddle structure, according to one or more aspects described herein.

FIG. 4A schematically depicts another example of a wrapped blade and paddle structure 400. The wrapped blade and paddle structure 400 includes a blade 402, which may be similar to blade 204, and a paddle 404, which may be similar to paddle 300. Additionally, FIG. 4A schematically depicts plug structures 406 and 408, which may be positioned on the paddle 404. The plug structures 406 and 408 may be configured to remain on the wrapped blade and paddle structure 400 during one or more molding processes and may be subsequently removed to reveal one or more recessed areas, similar to recessed areas 132 and 134, described in relation to FIG. 1A. In one example, the plug structures 406 and 408 may be constructed from a hard silicone material, and may be loosely positioned on the wrapped blade and paddle structure 400 prior to one or more molding processes, or may be removably coupled by one or more fasteners and/or adhesives to structure 400. However, additional or alternative materials may be used to construct the plug structures 406 and 408, which may include metals, alloys, polymers, and/or fiber-reinforced materials, without departing from the scope of these disclosures. Additionally, it is contemplated that the plug structures 406 and 408 may have different geometries to those depicted in FIG. 4A, which may be utilized to produce recessed areas of differing shapes, without departing from the scope of these disclosures.

Figure 4B:
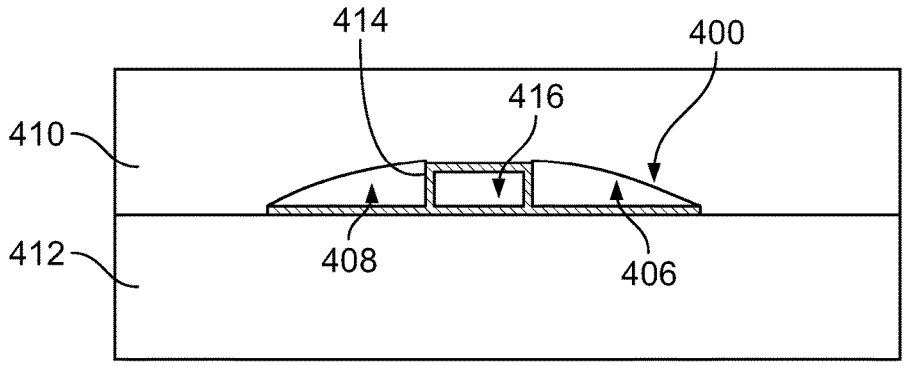
FIG. 4B schematically depicts a cross-section of a portion of FIG. 4A, according to one or more aspects described herein.

FIG. 4B schematically depicts a cross-section in the direction of the schematic cut line and arrows 4B-4B of FIG. 4A. The cross-section in FIG. 4B schematically depicts the wrapped blade and paddle structure 400 within a mold. As depicted, the mold may include two mold halves 410 and 412. FIG. 4B further depicts a cross-sectional view of a spine structure 414 having a silicone mandrel 416 positioned within. It is contemplated that the mold halves 410 and 412 may additionally impart a specific curvature to the blade 402, such that any blade curvature may be utilized, without departing from the scope of these disclosures. Further, it is contemplated that the mold halves 410 and 412 may apply pressure to the wrapped blade and paddle structure 400, and/or may be heated in order to fuse one or more of the structures of the wrapped blade and paddle structure 400 together. Accordingly, where used throughout this disclosure, a fiber tape, or carbon fiber tape, may include a carbon fiber material that is preimpregnated with one or more adhesives/resins that are activated by application of heat (i.e. heating within a mold, such as that mold formed by structures 410 and 412). As such, the adhesives/resins may be heated to a temperature at or above a melting point (e.g. above a melting point of the resin preimpregnated into carbon fiber tape). Upon cooling, the adhesive/resin solidifies, and maintains the shape of the mold upon extraction from the mold (e.g. maintains the desired hockey blade and/or paddle geometries). As such, the activation of the adhesive/resin within preimpregnated fiber tape may cause the adhesive/resin to melt and flow, and thereby result in adjacent structures being strongly bonded to one another upon cooling and solidification of the adhesive.

It is contemplated that any heating temperature and duration may be utilized, without departing from the scope of these disclosures. Further, any heating technology may be utilized, without departing from the scope of these disclosures. In one implementation, a molded hockey blade and paddle structure may be passively or actively cooled within, or following removal from the mold. It is further contemplated that the molded hockey blade and paddle structure may be formed with one or more recessed areas, similar to those recessed areas 132 and 134 described in relation to FIG. 1A, without the use of the removable plug structures 406 and 408, such that the mold (e.g. upper half 410 and/or lower half 412) may include geometric features configured to impart the desired recessed area geometries on the molded hockey blade and paddle structure. Additionally, it is contemplated that the mold structure used to form the geometry of the hockey blade and paddle may utilize female-female, or female-male, and/or or male-male mold configurations, and the mold halves 410 and 412 depicted in FIG. 4B are merely schematic representations.

Figure 5:
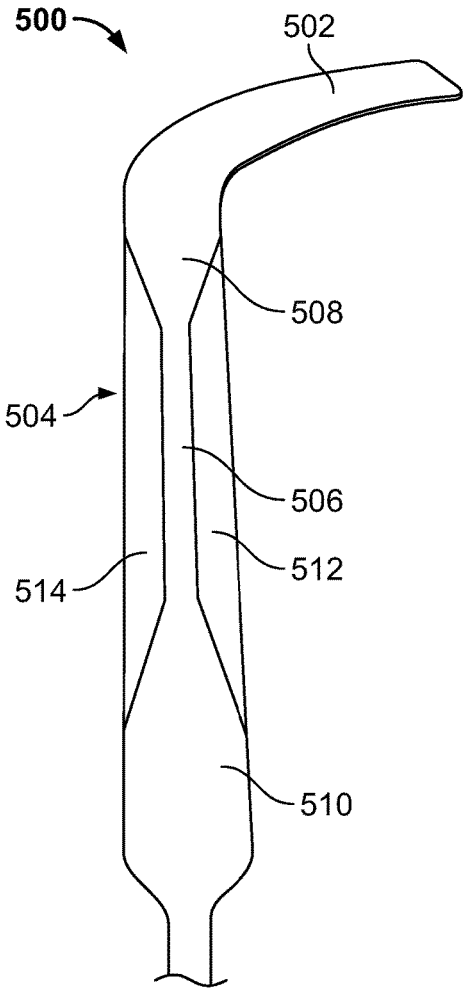
FIG. 5 depicts a molded hockey blade and paddle structure, according to one or more aspects described herein.
Figure 6:
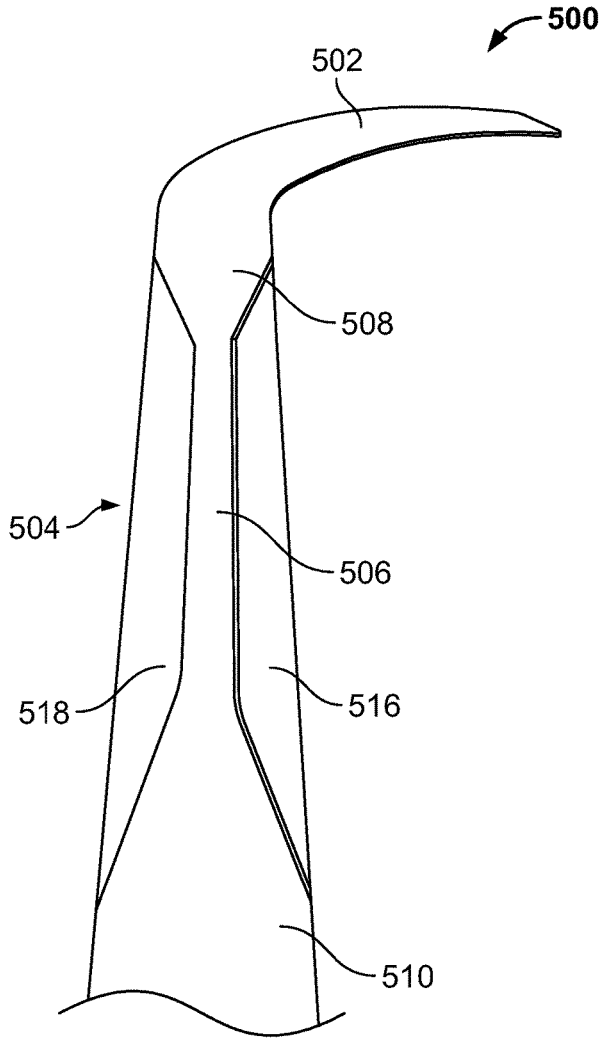
FIG. 6 depicts the molded hockey blade and paddle structure of FIG. 5 recessed areas visible, according to one or more aspects described herein.

FIG. 5 depicts a molded hockey blade and paddle structure 500, according to one or more aspects described herein. In particular, FIG. 5 depicts the molded hockey blade and paddle structure 500 that includes a blade 502, and a paddle 504. The molded hockey blade and paddle structure 500 additionally includes a spine 506 and first and second transition elements 508 and 510. Additionally, FIG. 5 depicts the molded hockey blade and paddle structure 500 with plug structures 512 and 514 coupled to the structure 500 following one or more molding processes. FIG. 6 depicts the same molded hockey blade and paddle structure 500 after the plug structures 512 and 514 have been removed to reveal the recessed areas 516 and 518. It is contemplated that the molded hockey blade and paddle structure 500 may have one or more layers of a polymer coating applied to the molded structure 500, and which may include graphics and stick colorations, without departing from the scope of these disclosures.

Figure 7B:
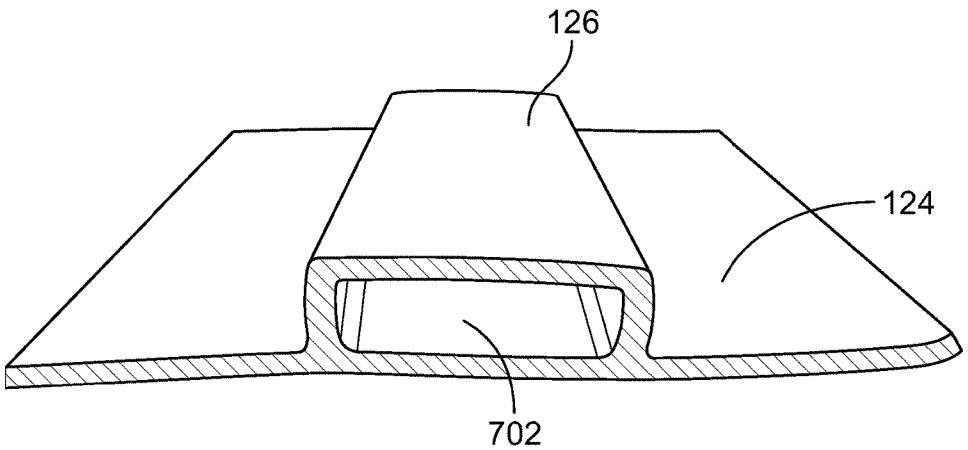
FIG. 7B depicts a cross-sectional view of a portion of the molded paddle of FIG. 7A, according to one or more aspects described herein.
Figure 7A:
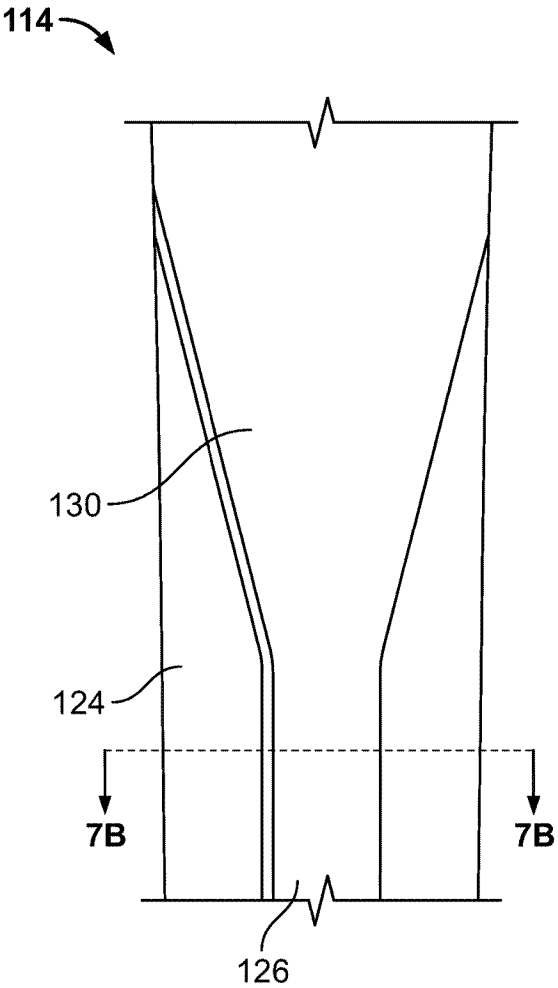
FIG. 7A depicts a portion of a molded paddle, according to one or more aspects described herein.

FIG. 7A depicts a portion of the molded paddle 114, according to one or more aspects described herein. FIG. 7B depicts a cross-sectional view of a portion of the molded paddle 114 in FIG. 7A, as indicated by the schematic cut line and arrows 7B-7B of FIG. 7A. As depicted, the rectangular spine 126 may be at least partially hollow, and have a cavity 702 extending along at least a portion of the back face 124 approximately parallel to a longitudinal axis of the paddle 114. In one implementation, a top edge 119 and/or bottom edge 121 of the paddle 114 may be rounded toward the back face 124 of the paddle 114.

Figure 8B:
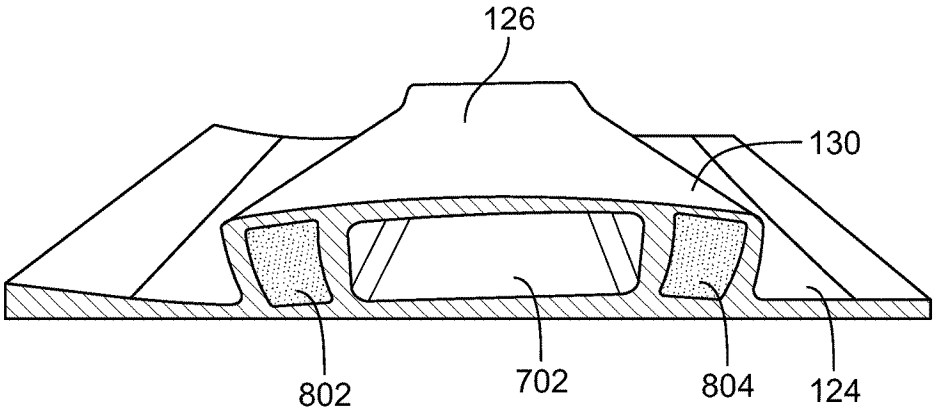
FIG. 8B depicts a cross-sectional view of a circled portion of the molded paddle of FIG. 8A, according to one or more aspects described herein.
Figure 8A:
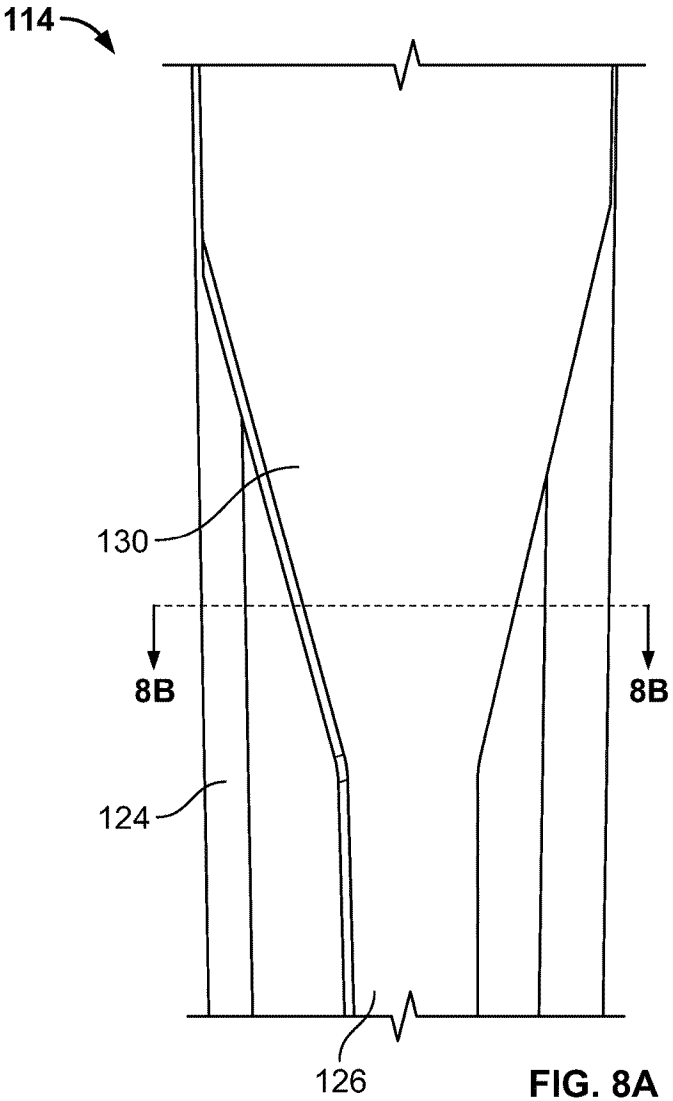
FIG. 8A depicts another portion of a molded paddle, according to one or more aspects described herein.

FIG. 8A depicts another portion of the molded paddle 114, according to one or more aspects described herein. FIG. 8B depicts a cross-sectional view of a portion of the molded paddle 114 in FIG. 8A, as indicated by the schematic cut line and arrows 8B-8B of FIG. 8A. As depicted, the cross-sectional view extends through the transition element 130, and depicts the cavity 702 of the spine 126 that extends into the transition element 130. Additionally, transition element foam cores 802 and 804 are depicted, which make up a portion of the internal structure of the transition element 130.

Figures 9, 10, 11:
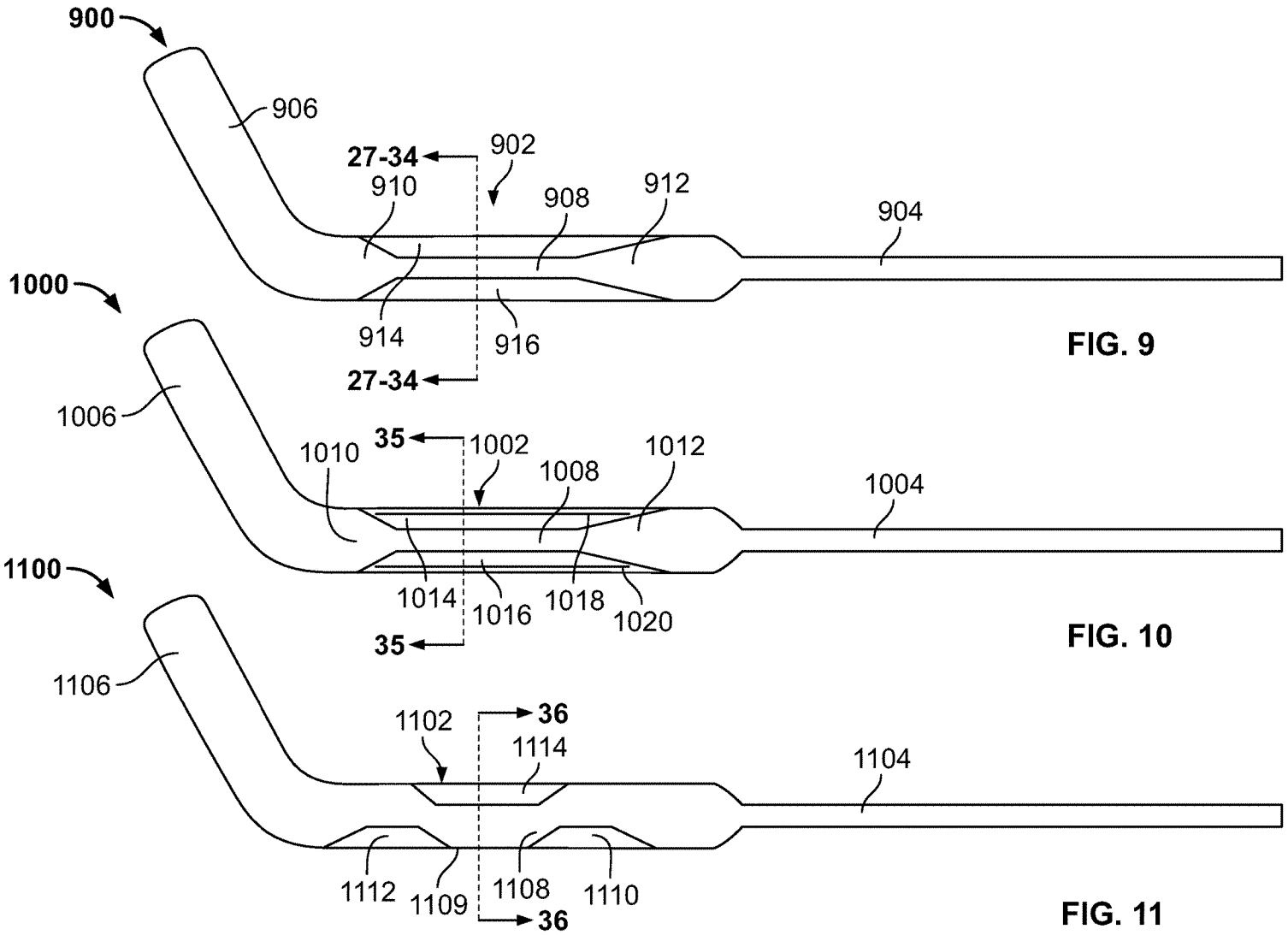
FIG. 9 schematically depicts an implementation of a hockey stick that has a spine-reinforced paddle, according to one or more aspects described herein.
FIG. 10 schematically depicts an implementation of a hockey stick that has a spine-reinforced paddle, according to one or more aspects described herein.
FIG. 11 schematically depicts an implementation of a hockey stick that has a spine-reinforced paddle, according to one or more aspects described herein.

FIG. 9 schematically depicts an implementation of a hockey stick 900 that has a spine-reinforced paddle 902. Similar to hockey stick 100, hockey stick 900 includes a shaft 904 and a blade 906. A spine 908 extends along a longitudinal axis of the paddle 902 between transition elements 910 and 912. The depicted backside of the paddle 902 further includes recessed areas 914 and 916 that extend along the longitudinal axis of the paddle 902 such that the spine 908 is centered on the back of the paddle 902. The cross-section of the spine 908, at the depicted cross-section arrows 27-34-27-34, may have any of the geometries described in relation to FIGS. 27-34, among others.

FIG. 10 schematically depicts another implementation of a hockey stick 1000 that has a spine-reinforced paddle 1002. Similar to hockey stick 900, stick 1000 includes shaft 1004 that is coupled to the paddle 1002, and the paddle 1002 is further coupled to a blade 1006. The depicted backside of the paddle 1002 also includes a spine 1008 extending between transition elements 1010 and 1012. Additionally, the depicted backside of the paddle 1002 includes recessed areas 1014 and 1016. Further, the recessed areas may be non-planar, and include, in one example, ridge elements 1018 and 1020. The cross-section of the spine 1008, at the depicted cross-section arrows 35-35, may have the geometry described in relation to FIG. 35, among others.

FIG. 11 schematically depicts another implementation of a hockey stick 1100 that has a spine-reinforced paddle 1102 that is coupled to a shaft 1104 and a blade 1106. In one example, the spine 1108 may extend along the depicted back side of the paddle 1102, and the spine 1008 may extend to a bottom edge of the paddle 1102 at area 1109. The paddle may include multiple recessed areas 1110 and 1112 along a bottom edge, and a single recessed area 1114 along a top edge. However, it is contemplated that one or more of the bottom edge and the top edge may include additional recessed areas to those depicted in FIG. 11, without departing from the scope of these disclosures. The cross-section of the spine 1108, at the depicted cross-section arrows 36-36, may have the geometry described in relation to FIG. 36, among others.

Figures 12, 13, 14:
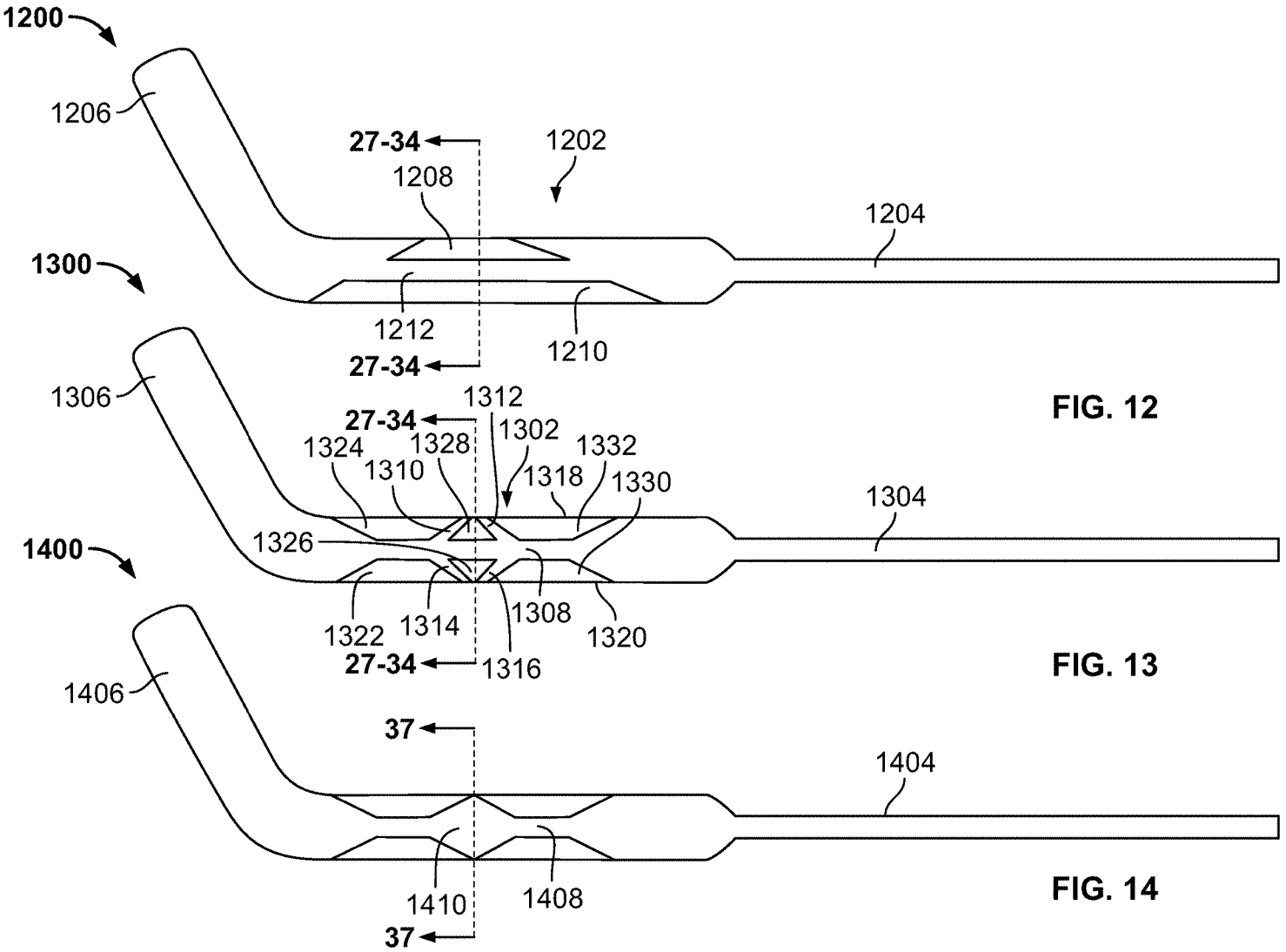
FIG. 12 schematically depicts another implementation of a hockey stick that has a spine-reinforced paddle, according to one or more aspects described herein.
FIG. 13 schematically depicts an implementation of a hockey stick that has a spine-reinforced paddle with reinforcement ribs, according to one or more aspects described herein.
FIG. 14 schematically depicts another implementation of a hockey stick that has a spine-reinforced paddle, according to one or more aspects described herein.

FIG. 12 schematically depicts another implementation of a hockey stick 1200 that has a spine-reinforced paddle 1202 that is coupled to a shaft 1204 and a blade 1206. In one example, the paddle 1202 may include a first recessed area 1208 separated from a second recessed area 1210 by a spine 1212, such that the first recessed area 1208 is smaller than the second recessed area 1210, and such that both of the recessed areas 1208 and 1210 have trapezoidal geometries. The cross-section of the spine 1212, at the depicted cross-section arrows 27-34-27-34, may have any of the geometries described in relation to FIGS. 27-34, among others.

FIG. 13 schematically depicts another implementation of a hockey stick 1300 that has a spine-reinforced paddle 1302 that is coupled to a shaft 1304 and a blade 1306. A spine 1308 may extend along at least a portion of the paddle 1302, and rib structures (e.g. rib structures 1310, 1312, 1314, and 1316) may extend from the spine 1308 to one or more of a top edge 1318 and a bottom edge 1320 of the paddle 1302. The spine 1308 and rib structures 1310-1316 may enclose recessed areas 1322-1332. The cross-section of the spine 1308, at the depicted cross-section arrows 27-34-27-34, may have any of the geometries described in relation to FIGS. 27-34, among others.

FIG. 14 schematically depicts another implementation of a hockey stick 1400 that has a spine-reinforced paddle 1402 that is coupled to a shaft 1404 and a blade 1406. In one example, a spine 1408 may extend along a portion of the depicted back side of the paddle 1402, and may additionally include a central area 1410 that extends to a top and a bottom edge of the paddle 1402. The cross-section of the spine 1408, at the depicted cross-section arrows 37-37, may have the geometry described in relation to FIG. 37, among others.

Figures 15, 16, 17:
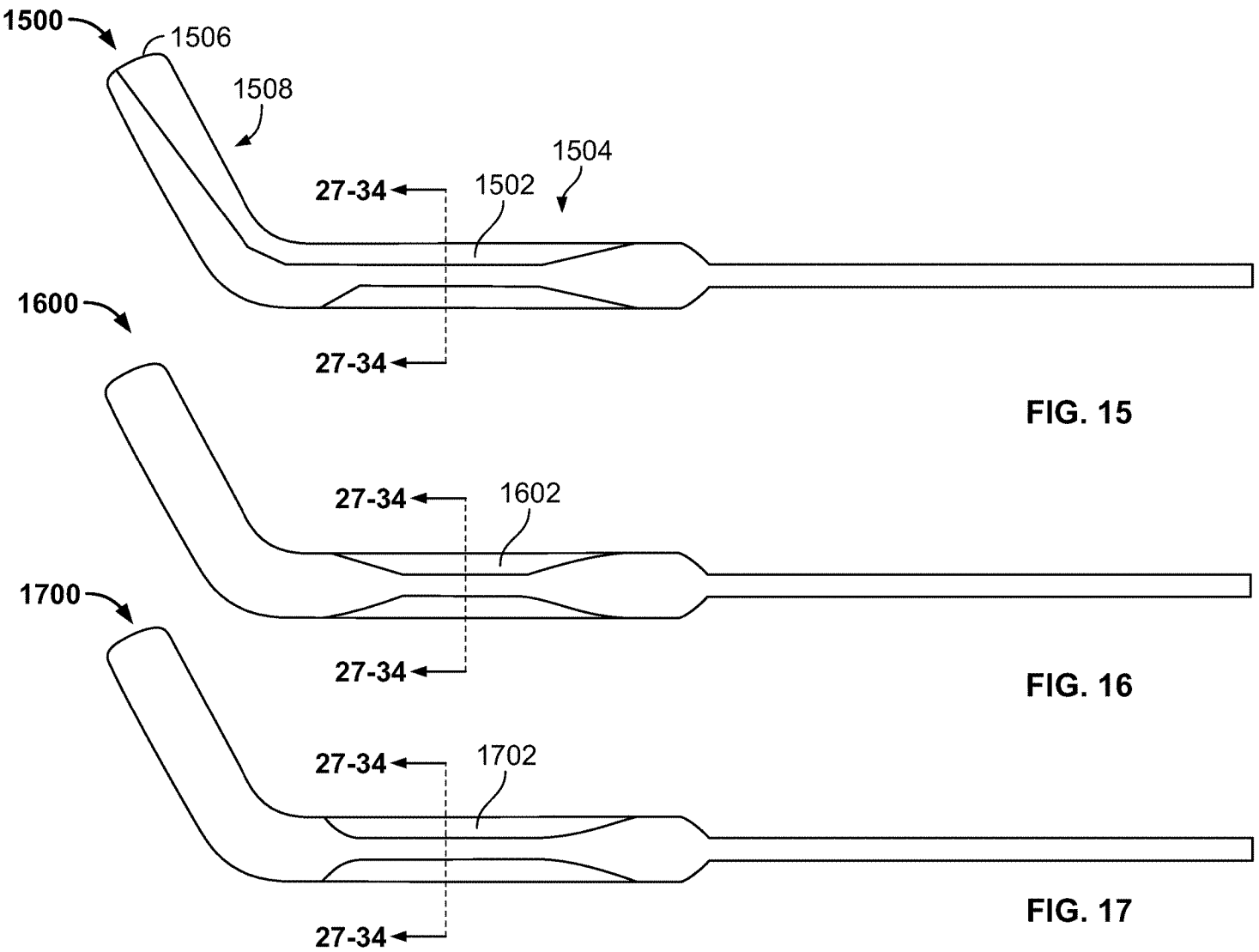
FIG. 15 schematically depicts another implementation of a hockey stick that has a spine-reinforced paddle and a recessed area extending across at least a portion of a paddle and blade structure, according to one or more aspects described herein.
FIG. 16 schematically depicts another implementation of a hockey stick that has a spine-reinforced paddle, according to one or more aspects described herein.
FIG. 17 schematically depicts another implementation of a hockey stick that has a spine-reinforced paddle, according to one or more aspects described herein.

FIGS. 15-17 schematically depict additional hockey stick implementations that include spine-reinforced paddles and different recessed area geometries. In one example, hockey stick 1500 from FIG. 15 includes a recessed area 1502 on a top edge of the stick that extends from a paddle 1504 to a toe 1506 of a blade 1508. FIGS. 16-17 schematically depict hockey sticks 1600 and 1700 that have recessed areas 1602 and 1702 with rounded geometries.

Figures 18, 19, 20:
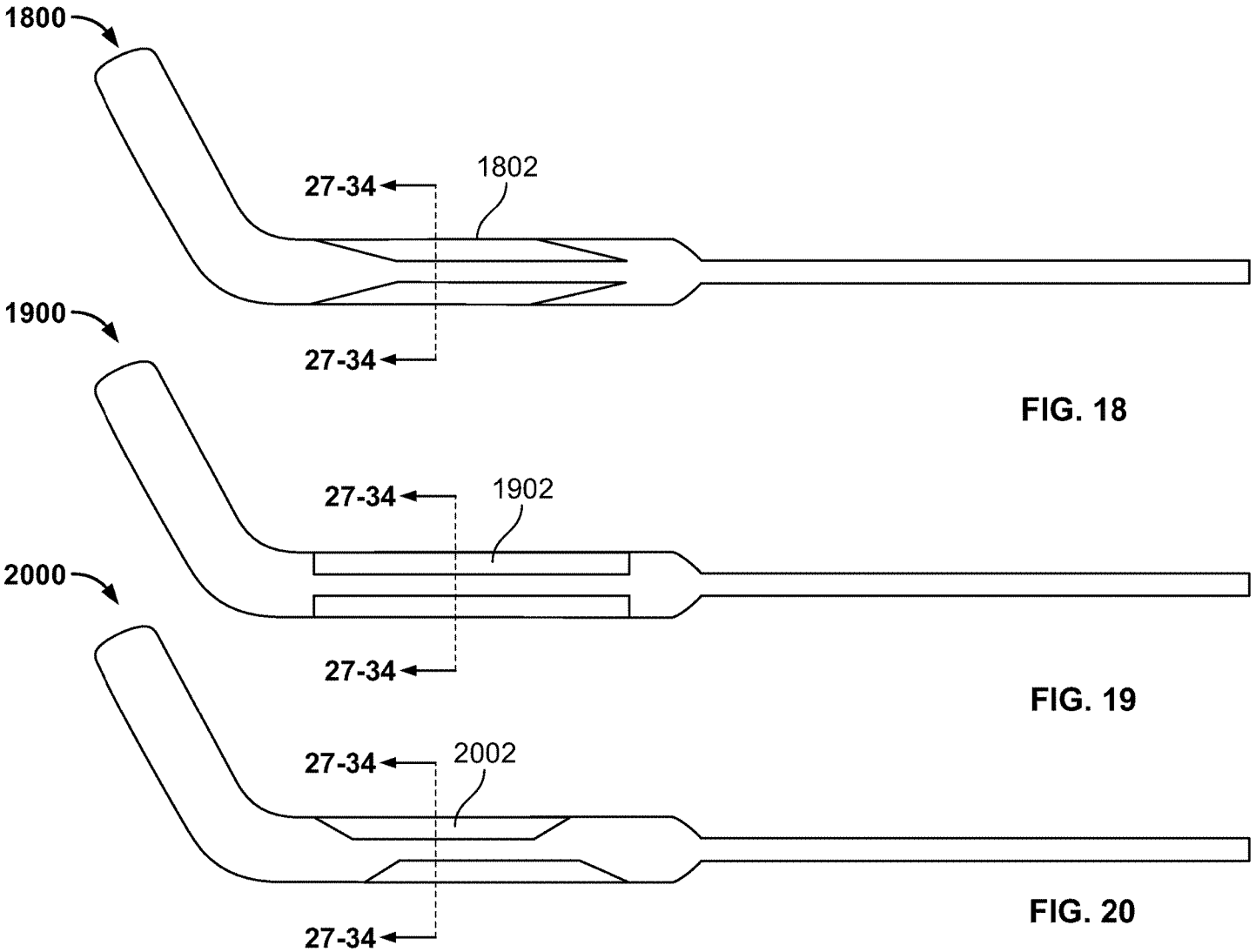
FIG. 18 schematically depicts another implementation of a hockey stick that has a spine-reinforced paddle, according to one or more aspects described herein.
FIG. 19 schematically depicts another implementation of a hockey stick that has a spine-reinforced paddle, according to one or more aspects described herein.
FIG. 20 schematically depicts another implementation of a hockey stick that has a spine-reinforced paddle, according to one or more aspects described herein.
Figures 21, 22, 23:
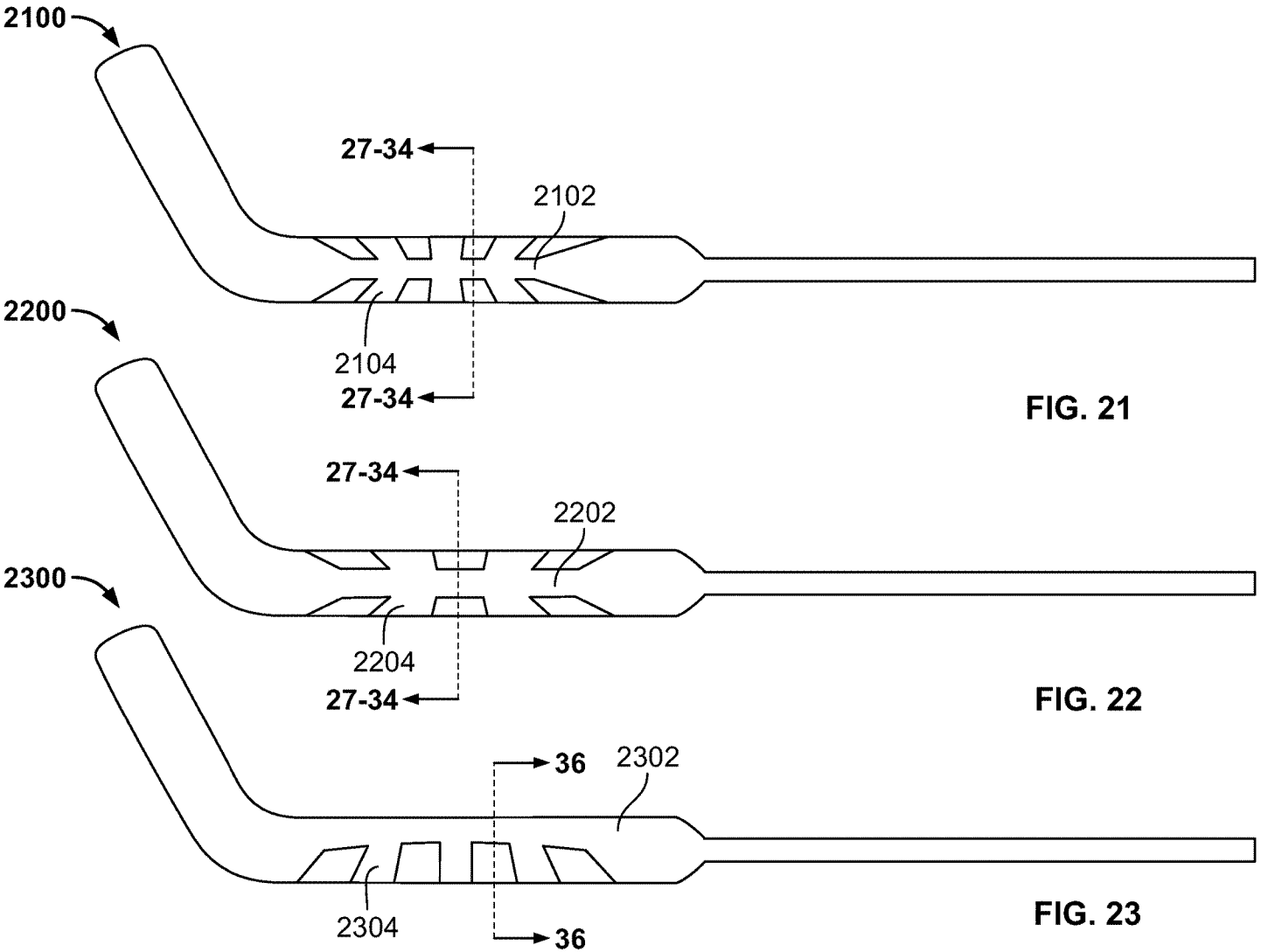
FIG. 21 schematically depicts another implementation of a hockey stick that has a spine-reinforced paddle with reinforcing ribs, according to one or more aspects described herein.
FIG. 22 schematically depicts another implementation of a hockey stick that has a spine-reinforced paddle with reinforcing ribs, according to one or more aspects described herein.
FIG. 23 schematically depicts another implementation of a hockey stick that has a spine-reinforced paddle with reinforcing ribs, according to one or more aspects described herein.
Figures 24, 25, 26:
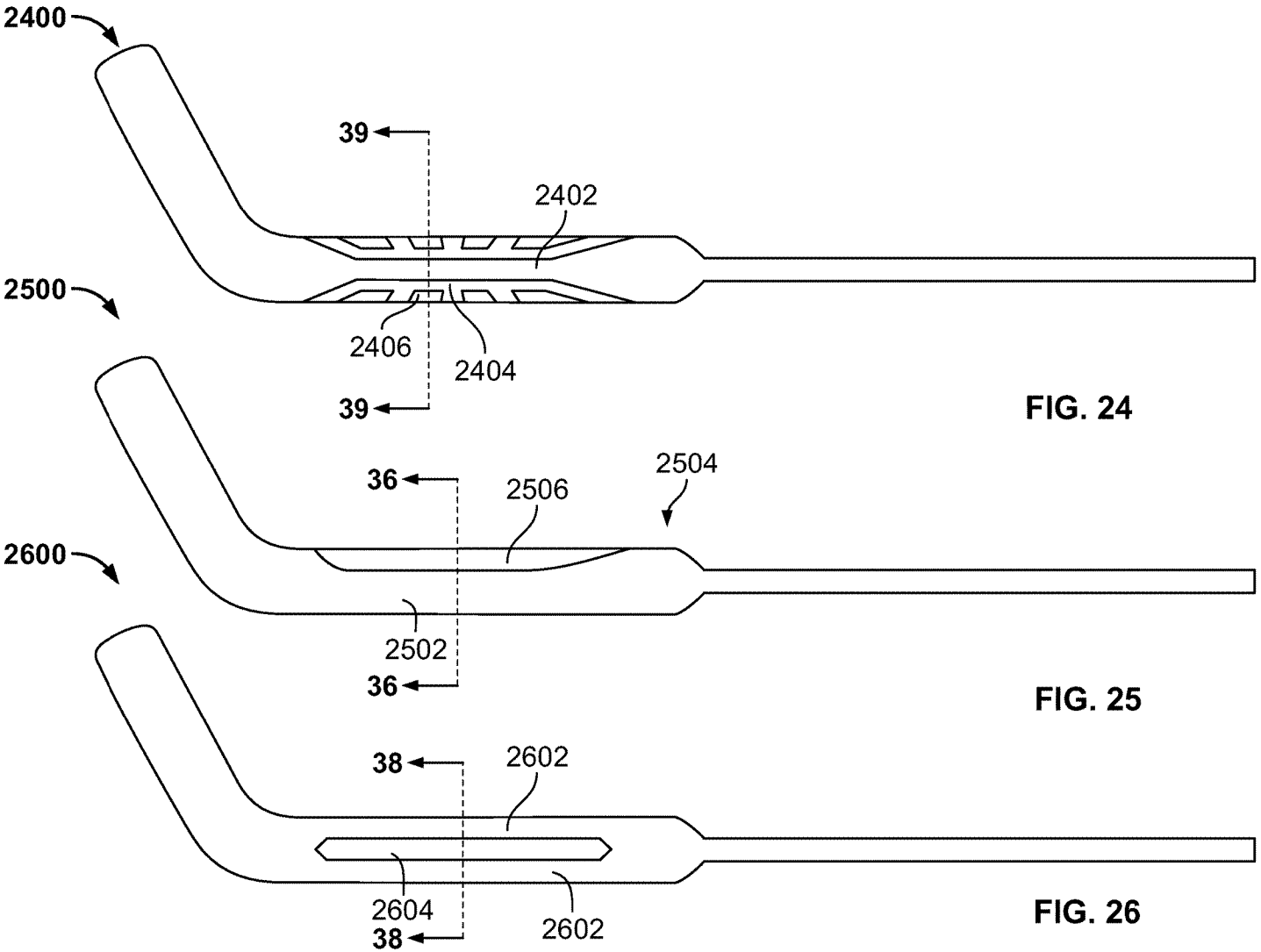
FIG. 24 schematically depicts another implementation of a hockey stick that has a spine-reinforced paddle, according to one or more aspects described herein.
FIG. 25 schematically depicts another implementation of a hockey stick that has a spine-reinforced paddle, according to one or more aspects described herein.
FIG. 26 schematically depicts another implementation of a hockey stick that has a spine-reinforced paddle with a bifurcated spine structure, according to one or more aspects described herein.

FIGS. 18-20 schematically depict different implementations of hockey sticks 1800, 1900, and 2000, with spine-reinforced paddles, and having recessed areas 1802, 1902, and 2002 with different trapezoidal geometries. FIGS. 21-23 schematically depict different implementations of hockey sticks 2100, 2200, and 2300 that have paddles reinforced by spines 2102, 2202 and 2302, and different rib geometries 2104, 2204, and 2304. FIGS. 24-26 schematically depict different implementation of hockey sticks 2400, 2500, and 2600. In one example, hockey stick 2400 has a central reinforcing spine 2402, a recessed area 2404, and stud elements 2406 that are at least partially surrounded by the recessed area 2404. In one implementation, the stud elements 2406 may have a thickness greater than a thickness of the recessed area 2404.

The cross-sections of the spines of sticks 1500, 1600, 1700, 1800, 1900, 2000, 2100, and 2200 at the depicted cross-section arrows 27-34-27-34, may have any of the geometries described in relation to FIGS. 27-34, among others. The cross-section of the spine 2302, at the depicted cross-section arrows 36-36, may have the geometry described in relation to FIG. 36, among others. The cross-section of the spine 2402, at the depicted cross-section arrows 39-39, may have the geometry described in relation to FIG. 39, among others.

FIG. 25 schematically depicts the hockey stick 2500 having a spine structure 2502 that is positioned on a bottom portion of a back side of a paddle 2504. Further, the paddle 2504 may have a recessed area 2506 on a top portion of the paddle 2504. FIG. 26 schematically depicts an alternative implementation of a hockey stick 2600 having a bifurcated spine 2602 and a central recessed area 2604, according to one or more aspects described herein. The cross-section of the spine 2502, at the depicted cross-section arrows 36-36, may have the geometry described in relation to FIG. 36, among others. The cross-section of the spine 2602, at the depicted cross-section arrows 38-38, may have the geometry described in relation to FIG. 38, among others.

Figure 27:
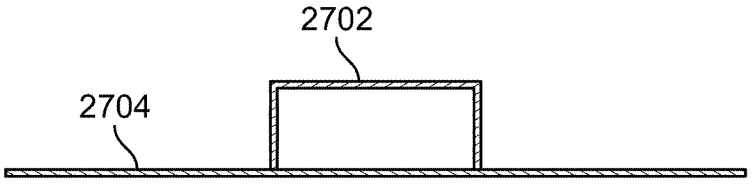
FIG. 27 schematically depicts an example cross-section of a hockey stick paddle and spine, according to one or more aspects described herein.

In addition to the rectangular cross-section of the spine 126, as depicted in FIG. 7B, various alternative spine cross-sections may be used, without departing from the scope of these disclosures. FIGS. 27-39 schematically depict various alternative hockey stick paddle cross-sections, and it is contemplated that the relative sizes and dimensions of the various schematically-depicted elements may have any values, without departing from the scope of these disclosures. It is further contemplated that the various elements depicted in FIGS. 27-39 may be constructed using any materials and/or processes as previously described throughout these disclosures. FIG. 27 schematically depicts a first example cross-section, with a rectangular spine cross-section 2702 and a paddle face cross-section 2704 that is substantially planar. In one example, the rectangular spine cross-section 2702 and the paddle face cross-section 2704 may have approximately equal thicknesses.

Figure 28:
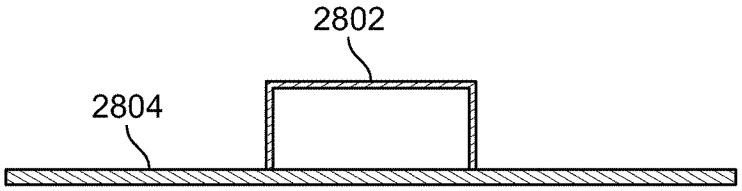
FIG. 28 schematically depicts another example cross-section of a hockey stick paddle and spine, according to one or more aspects described herein.

FIG. 28 schematically depicts another example cross-section, with a rectangular spine cross-section 2802 and a paddle face cross-section 2804 that is substantially planar. In one example, the paddle face cross-section 2804 may have a greater material thickness than the rectangular spine cross-section 2802.

Figure 29:
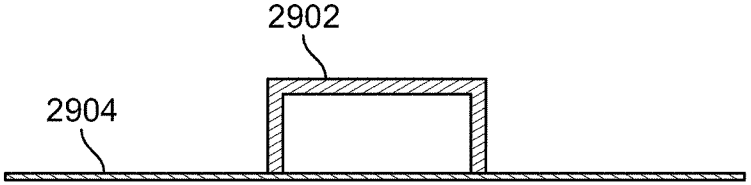
FIG. 29 schematically depicts another example cross-section of a hockey stick paddle and spine, according to one or more aspects described herein.

FIG. 29 schematically depicts another example cross-section, with a rectangular spine cross-section 2902 and a paddle face cross-section 2904 that is substantially planar. In one example, the rectangular spine cross-section 2902 may have a greater material thickness than the paddle face cross-section 2904.

Figure 30:
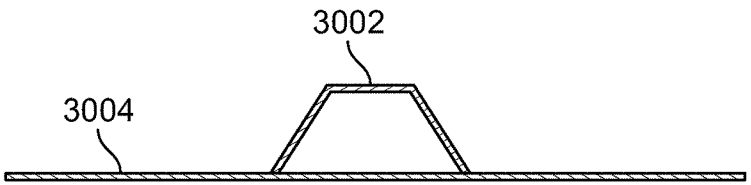
FIG. 30 schematically depicts another example cross-section of a hockey stick paddle and spine, according to one or more aspects described herein.

FIG. 30 schematically depicts another example cross-section, with a trapezoidal spine cross-section 3002, and a paddle face cross-section 3004 that is substantially planar. In one example, a longer length of the trapezoidal spine cross-section 3002 may be coupled to the paddle face cross-section 3004, as schematically depicted in FIG. 30.

Figure 31:
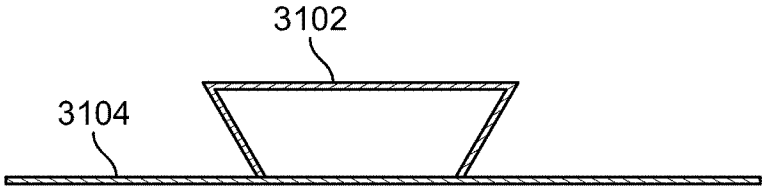
FIG. 31 schematically depicts another example cross-section of a hockey stick paddle and spine, according to one or more aspects described herein.

FIG. 31 schematically depicts another example cross-section, with a trapezoidal spine cross-section 3102, and a paddle face cross-section 3104 that is substantially planar. In one example, a short or length of the trapezoidal spine cross-section 3102 may be coupled to the paddle face cross-section 3104, as schematically depicted in FIG. 31.

Figure 32:
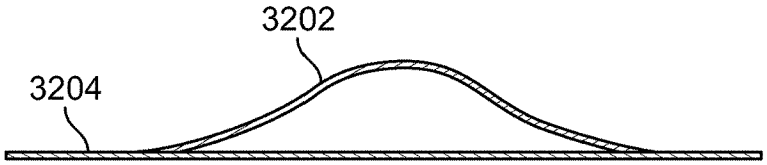
FIG. 32 schematically depicts another example cross-section of a hockey stick paddle and spine, according to one or more aspects described herein.

FIG. 32 schematically depicts another example cross-section, with a bell-curve spine cross-section 3202 and a paddle face cross-section 3204 that is substantially planar.

Figure 33:
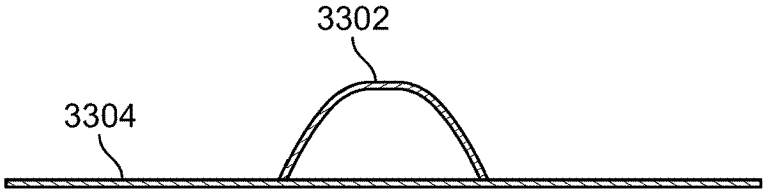
FIG. 33 schematically depicts another example cross-section of a hockey stick paddle and spine, according to one or more aspects described herein.

FIG. 33 schematically depicts another example cross-section, with a rounded spine cross-section 3302 and a paddle face cross-section 3304 that is substantially planar.

Figure 34:
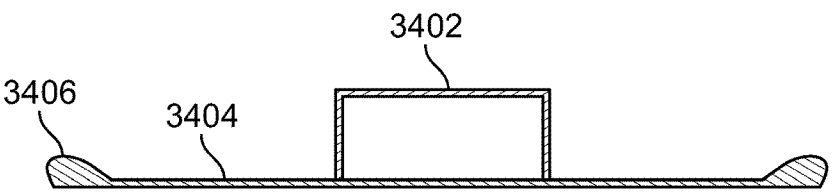
FIG. 34 schematically depicts another example cross-section of a hockey stick paddle and spine, according to one or more aspects described herein.

FIG. 34 schematically depicts another example cross-section, with a rectangular spine cross-section 3402 and a paddle face cross-section 3404 that has thickened and rounded edges 3406.

Figure 35:
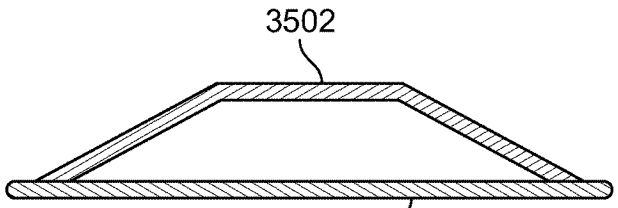
FIG. 35 schematically depicts another example cross-section of a hockey stick paddle and spine, according to one or more aspects described herein.

FIG. 35 schematically depicts another example cross-section, with a trapezoidal spine cross-section 3502 and a paddle face cross-section 3504.

Figure 36:
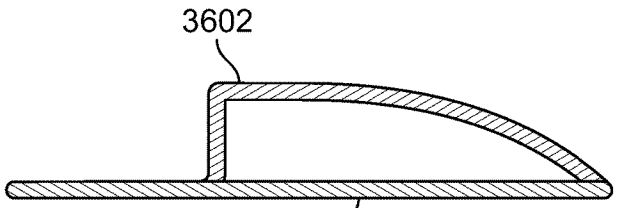
FIG. 36 schematically depicts another example cross-section of a hockey stick paddle and spine, according to one or more aspects described herein.

FIG. 36 schematically depicts another example cross-section, with a partial curve spine cross-section 3602 and a paddle face cross-section 3604.

Figure 37:
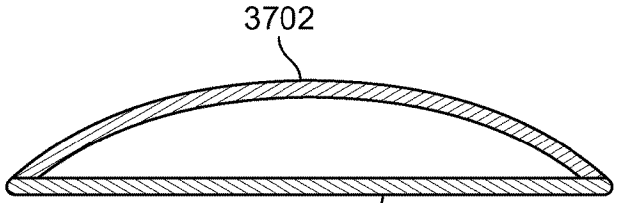
FIG. 37 schematically depicts another example cross-section of a hockey stick paddle and spine, according to one or more aspects described herein.

FIG. 37 schematically depicts another example cross-section, with a curved spine cross-section 3702 and a paddle face cross-section 3704.

Figure 38:
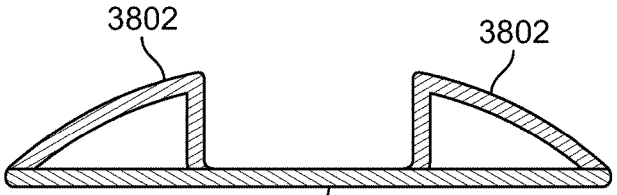
FIG. 38 schematically depicts another example cross-section of a hockey stick paddle and spine, according to one or more aspects described herein.

FIG. 38 schematically depicts another example cross-section, having two curved portions of a spine cross-section 3802 and a paddle face cross-section 3804.

Figure 39:
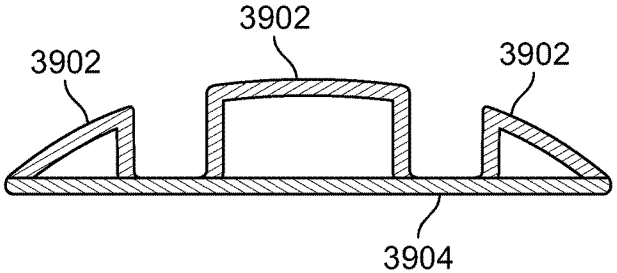
FIG. 39 schematically depicts another example cross-section of a hockey stick paddle and spine, according to one or more aspects described herein.

FIG. 39 schematically depicts another example cross-section, having three curved portions of a spine cross-section 3902 and a paddle face cross-section 3904.

In one aspect, a hockey stick apparatus may include a shaft that has a proximal end and a distal end, a blade that has a proximal end and a distal end, and a paddle that has a length extending between a proximal end and a distal end, and a width extending between a top edge and a bottom edge. The distal end of the paddle may be coupled to the proximal end of the blade, and the proximal end of the paddle may be coupled to the distal end of the shaft. The paddle may also include a front face, and a back face, with the back face having a spine that extends along a portion of the back face. The spine may be coupled to and protruding out from the back face, and the spine may have a second width that is less than the first width. The spine may also have a proximal end and a distal end, with a first transition element coupled to the proximal end of the spine and to the proximal end of the paddle. A second transition element may be coupled to the distal end of the spine and the distal end of the paddle. The back face of the paddle may also include a recessed area, with the recessed area having a first thickness, such that a second thickness of the paddle between the front face and a back surface of the spine may be greater than the first thickness.

The spine of the hockey stick apparatus may include a rectangular shaft, a circular shaft, a semicircular shaft, a triangular shaft, or an I-beam shaft that extends along a portion of the back face approximately parallel to a longitudinal axis of the paddle.

The spine of the hockey stick apparatus may be at least partially hollow and have a cavity extending along at least a portion of the back face approximately parallel to a longitudinal axis of the paddle.

The paddle of the hockey stick may also include a rib structure that is coupled to the spine and to the back face, and extending from the spine to the top edge or the bottom edge. At least a portion of the rib structure may have a thickness approximately equal to the second thickness of the paddle between the front face and a back surface of the spine.

The paddle may also include a stood that is coupled to and protruding out from the back face. The stud may have a third thickness between the front face and a back surface of the stud that is greater than the first thickness between the front and back faces of the paddle. The stud may be at least partially surrounded by the recessed area on the back face of the paddle.

The recessed area may extend to a portion of a back face of the blade of the hockey stick apparatus.

At least a portion of the top edge of the bottom edge of the paddle may be rounded back toward the back face.

The front face of the paddle may be substantially planar, concave, or convex, or combinations thereof.

A width of the first and second transition elements may vary between the first width of the paddle and a second width of the spine.

The shaft, the paddle, and the blade of the hockey stick may be integrally molded together.

The spine may extend at least partially into the first and second transition elements of the hockey stick apparatus.

In another aspect, a hockey stick blade and paddle structure may be formed by a method that includes forming a first foam core of the blade, and wrapping the first foam core of the blade with a layer of fiber tape to form a wrapped blade core. Additionally, the method may include forming a front face and a back face of the paddle, which is coupled to a proximal end of the wrapped blade core, by layering fiber tape. A spine may be formed by wrapping a mandrel with fiber tape, and first and second transition elements may be formed by wrapping first and second transition element foam cores with fiber tape. The spine may be positioned on the back face. The first transition element may be positioned at a proximal end of the back face of the paddle, and the second transition element may be positioned at a distal end of the back face of the paddle. The front face, as well as the positioned spine and transition elements on the back face may be wrapped with fiber tape to form a wrapped paddle structure. The wrapped blade core, which may be coupled to the wrapped paddle structure, may be placed in a mold, and the mold may be heated and cooled. The mandrel may be removed from the spine, and the formed hockey stick blade and paddle structure may be removed from the mold.

The method for forming the hockey stick blade and paddle structure may additionally include positioning a plug element on the back surface of the paddle beside the spine prior to heating the mold, and removing the plug element from the back surface following the molding to reveal a recessed area.

The mandrel used to form the spine may include a silicone material. Further, the spine may include a hollow rectangular, circular, semicircular, or triangular shaft.

In another aspect, a hockey stick paddle structure may be formed by a method that includes forming a front face and a back face of the paddle by layering fiber tape. A spine may be formed by wrapping a mandrel with fiber tape, and first and second transition elements may be formed by wrapping first and second transition element foam cores with fiber tape. The spine may be positioned on the back face. The first transition element may be positioned at a proximal end of the back face of the paddle, and the second transition element may be positioned at a distal end of the back face of the paddle. The front face, as well as the positioned spine and transition elements on the back face may be wrapped with fiber tape to form a wrapped paddle structure. The wrapped paddle structure may be placed in a mold, and the mold may be heated and cooled. The mandrel may be removed from the spine, and the formed hockey stick paddle structure may be removed from the mold.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. A hockey stick blade and paddle structure formed by a method comprising:

forming a first foam core of the blade;

wrapping the first foam core of the blade with a layer of fiber tape to form a wrapped blade core;

forming a front face and a back face of the paddle, coupled to a proximal end of the wrapped blade core, by layering fiber tape;

forming a spine by wrapping a mandrel with fiber tape;

forming first and second transition elements by wrapping first and second transition element foam cores with fiber tape;

positioning the spine on the back face;

positioning the first transition element at a proximal end of the back face of the paddle and the second transitional element at a distal end of the back face of the paddle;

wrapping the front face and the positioned spine and transition elements on the back face with fiber tape to form a wrapped paddle structure;

placing the wrapped blade core coupled to the wrapped paddle structure in a mold;

heating the mold;

cooling the mold; and removing the mandrel from the spine and the formed hockey stick blade and paddle structure form the mold.

2. The hockey stick blade and paddle structure of claim 1, wherein the method further comprises:

positioning a plug element on the back face proximate the spine prior to heating the mold; and removing the plug element from the back face following the cooling of the mold to reveal a recessed area.

3. The hockey stick blade and paddle structure of claim 1, wherein the mandrel comprises a silicone material.

4. The hockey stick blade and paddle structure of claim 1, wherein the spine comprises a hollow rectangular shaft.

5. The hockey stick blade and paddle structure of claim 1, wherein the spine comprises a hollow circular or semi-circular shaft.

6. The hockey stick blade and paddle structure of claim 1, wherein the spine comprises a hollow triangular shaft.

7. The hockey stick blade and paddle structure of claim 1, wherein the back face of the paddle has a first width and the spine has a second width, less than the first width.

8. A method of fabricating a formed hockey stick paddle structure, comprising:

forming a body of the paddle structure having a front face and a back face by layering fiber tape;

forming a spine by wrapping a mandrel with fiber tape;

forming first and second transition elements by wrapping first and second transition element foam cores with fiber tape;

positioning the spine on the back face;

positioning the first transition element at a proximal end of the back face of the paddle and the second transitional element at a distal end of the back face of the paddle;

placing the body of the paddle, the positioned spine, and first and second transition elements in a mold;

heating the mold;

cooling the mold; and removing the mandrel from the spine.

9. The method of claim 8, wherein the method further comprises:

positioning a plug element on the back face proximate the spine prior to heating the mold; and removing the plug element from the back face following the cooling of the mold to reveal a recessed area.

10. The method of claim 8, wherein the mandrel comprises a silicone material.

11. The method of claim 8, wherein the spine comprises a hollow rectangular shaft.

12. The method of claim 8, wherein the spine comprises a hollow circular or semi-circular shaft.

13. The method of claim 8, wherein the spine comprises a hollow triangular shaft.

14. The method of claim 8, wherein the back face of the paddle has a first width and the spine has a second width, less than the first width.

15. A method of fabricating a hockey stick apparatus comprising:

forming a shaft, having a proximal end and a distal end;

forming a blade, having a heel end and a toe end; and forming a paddle comprising a top edge and a bottom edge, the paddle having a length extending between a proximal end and a distal end, and a first width extending between the top edge and the bottom edge, the distal end of the paddle coupled to the heel end of the blade, and the proximal end of the paddle coupled to the distal end of the shaft, the paddle further comprising:

a front face;

a back face, the back face further comprising:

a spine extending along a portion of the back face, the spine coupled to and protruding out from the back face, the spine having a second width less than the first width, a proximal end, and a distal end;

a stud, coupled to and protruding out from the back face; and a recessed area, the recessed area having a first thickness, wherein a second thickness of the paddle between the front face and a back surface of the spine is greater than the first thickness, and wherein a third thickness of the paddle between the front face and a back surface of the stud is greater than the first thickness, and wherein the stud is at least partially surrounded by the recessed area.

16. The method of claim 15, wherein the spine comprises a rectangular shaft extending along a portion of the back face approximately parallel to a longitudinal axis of the paddle.

17. The method of claim 15, wherein the spine comprises a circular or semi-circular shaft extending along a portion of the back face approximately parallel to a longitudinal axis of the paddle.

18. The method of claim 15, wherein the spine comprises a triangular shaft extending along a portion of the back face approximately parallel to a longitudinal axis of the paddle.

19. The method of claim 15, wherein the spine comprises an I-beam shaft extending along a portion of the back face approximately parallel to a longitudinal axis of the paddle.

20. The method of claim 15, wherein the spine is at least partially hollow and has a cavity extending along at least a portion of the back face approximately parallel to a longitudinal axis of the paddle.

* * * * *